US005284298A

United States Patent [19]

Haynes et al.

[11] Patent Number: 5,284,298

[45] Date of Patent: Feb. 8, 1994

[54] FLUID-CONDUCTING SWIVEL AND METHOD

[75] Inventors: Henry T. Haynes, Jenks; Earl E. Thompson, Sr., Tulsa, both of Okla.

[73] Assignee: Fluid Controls Inc., Tulsa, Okla.

[21] Appl. No.: 46,646

[22] Filed: Apr. 13, 1993

[51] Int. Cl.[5] ..... B05B 3/06

[52] U.S. Cl. ..... 239/254; 239/256; 239/259; 277/3; 277/72 FM; 277/DIG. 8

[58] Field of Search ..... 239/251, 254, 256, 259, 239/252; 134/179; 277/3, 72 FM, DIG. 8, 135

[56] References Cited

U.S. PATENT DOCUMENTS

| | | | |
|---|---|---|---|
| 486,829 | 11/1892 | Hart | 239/259 |
| 2,597,931 | 5/1952 | Hance | 134/179 X |
| 2,746,795 | 5/1956 | Kofoid | 239/256 |
| 3,180,348 | 4/1965 | Clearman | 239/251 |
| 3,807,636 | 4/1974 | Fackler | 239/251 |
| 4,191,590 | 3/1980 | Sundheim | 239/251 |
| 4,715,539 | 12/1987 | Steele | 239/259 X |
| 4,923,120 | 5/1990 | Hammelmann | 134/179 |
| 5,060,862 | 10/1991 | Pacht | 239/252 |

*Primary Examiner*—Andres Kashnikow
*Assistant Examiner*—Lesley D. Morris
*Attorney, Agent, or Firm*—Dougherty, Hessin, Beavers & Gilbert

[57] ABSTRACT

A fluid-conducting swivel includes an upstream conduit, downstream conduit, and support assembly for holding the upstream and downstream conduit with their flow passageways aligned, allowing rotation of one of the upstream and downstream conduit, and maintaining a space between the adjacent ends of the conduit. The upstream conduit includes an acceleration nozzle for accelerating the velocity of the fluid flow to such a velocity that the fluid creates a substantially self-contained fluid jet. The downstream conduit includes a deceleration nozzle for decelerating the velocity of the fluid flow and a downstream throat extending between the deceleration nozzle and the end of the downstream conduit adjacent the upstream conduit. The downstream throat receives the accelerated fluid from the upstream conduit and is sized to substantially prevent expansion of the accelerated fluid and thereby prevent fluid leakage and pressure loss between the upstream and downstream conduit.

20 Claims, 2 Drawing Sheets

FLUID-CONDUCTING SWIVEL AND METHOD

BACKGROUND OF THE INVENTION

This invention relates to a fluid-conducting swivel and method for operating the same and, more particularly, but not by way of limitation, relates to such a swivel which is free of friction creating seals.

Fluid-conducting swivels are known and commercially available. Typical applications include fluid-driven rotating machinery and tools and fluid-spraying rotating cleaning equipment. Shortcomings of prior fluid-conducting swivels include the use of O-rings, packing, or other friction-generating seals which make surface contact to seal and prevent fluid passage between the relatively rotating members of the swivels. The friction created by such seals reduces the efficiency of the equipment and increases the required maintenance. The physical contact between such seals and the rotating member(s) generates the friction which retards the ability of the members to rotate and which causes the seal to deteriorate relatively rapidly.

U.S. Pat. No. 4,923,120 to Hammelmann discloses a nozzle device having a labyrinth-like sealing gap which requires close machining tolerances and appears to be relatively expensive to manufacture and assemble. Hammelmann also discloses using a vacuum created at the outlet of a pressurized orifice to draw fluid through the labyrinth-like sealing gap and improve its sealing action. This ingestion or inspiration through the gap increases the pressure lost in the nozzle device.

Therefore, there is a need for a fluid-conducting swivel and method of operating the same which does not require the use of friction-generating seals or relatively expensive labyrinth-type seals, which requires little if any pressure loss across the swivel, and which is relatively inexpensive to manufacture and maintain.

SUMMARY OF THE INVENTION

The present invention is contemplated to overcome the foregoing deficiencies and meet the above-described needs. In accomplishing this, the present invention provides a novel and improved fluid-conducting swivel and method of operating such a swivel.

The inventive swivel includes an upstream conduit, a downstream conduit, and support means. The upstream conduit has a first end connectable to a fluid source, a second end, and a fluid passageway extending through the first and second ends. The upstream conduit includes an acceleration nozzle disposed in the fluid passageway for accelerating the velocity of the fluid flow in the fluid passageway and an upstream throat extending between the acceleration nozzle and the second end of the upstream conduit for maintaining the accelerated velocity of the fluid flow from the acceleration nozzle.

The downstream conduit has a first end connectable to a fluid user, a second end, and a fluid passageway extending through the first and second ends. The downstream conduit includes a deceleration nozzle disposed in the fluid passageway for decelerating the velocity of the fluid flow in the fluid passageway and a downstream throat extending between the deceleration nozzle and the second end of the downstream conduit for receiving the accelerated fluid from the upstream throat and substantially preventing expansion of the accelerated fluid.

A support means is used for holding the upstream and downstream conduit with the upstream and downstream throats properly aligned. The preferred support means is also used for allowing rotation of one or both of the upstream and downstream conduit and for maintaining a space or gap between the upstream and downstream conduit and between the upstream and downstream throats.

The acceleration nozzle is sized to reduce the size of the fluid passageway and accelerate the velocity of the fluid flow to such a velocity that the fluid creates a substantially self-contained fluid jet which exerts substantially no pressure on the walls of the upstream and downstream throats. The upstream and downstream throats are sized to maintain the fluid flow at a substantially constant velocity between the upstream throat and the deceleration nozzle. The downstream throat has substantially the same cross-sectional area and shape as the upstream throat in order to substantially prevent dissociation and expansion of the fluid in the gap between the upstream and downstream throats and in the downstream throat.

A preferred fluid user includes at least one discharge nozzle in fluid communication with the first end of the downstream conduit. The discharge nozzle is displaced radially with respect to the flow axis of the downstream throat and is directed in a generally downstream direction along an axis that is skewed with respect to the flow axis and lies in a plane parallel to the flow axis in order to cause rotation of the downstream conduit about the flow axis.

It is an advantage of the present invention to provide a fluid-velocity-coupled swivel which eliminates the need for friction-generating surface-contacting seals.

It is an advantage of the present invention to provide a friction-generating-seal-free fluid coupling and swivel that has the advantages of a sealed coupling (low pressure drop and low leakage) but that does not require the maintenance or have the friction-generating seal contact of the sealed couplings.

It is an advantage of the present invention to provide such a swivel which is adaptable for use with fluid-driven rotating surface-cleaning devices and which will facilitate higher rotational velocities than prior swivels having friction-generating contact sealing and which will therefore clean much faster and require less maintenance.

BRIEF DESCRIPTION OF THE DRAWINGS

The present invention will be better understood by reference to the example of the following drawings.

DETAILED DESCRIPTION OF THE PREFERRED EMBODIMENTS

Figure 1:
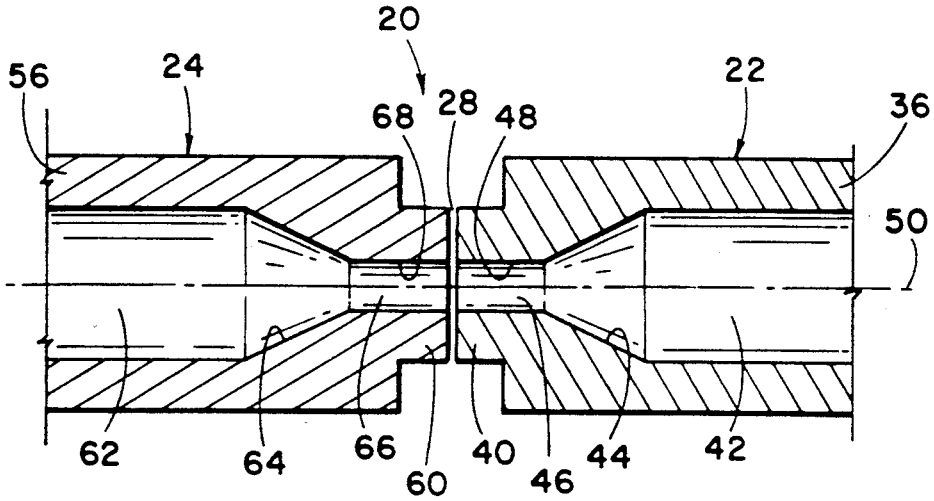
FIG. 1 is a schematic diagram of an embodiment of a swivel of the present invention.

Preferred embodiments of the invention will now be described with reference to the drawings. Like reference characters refer to like or corresponding parts throughout the drawings and description.

Figure 2:
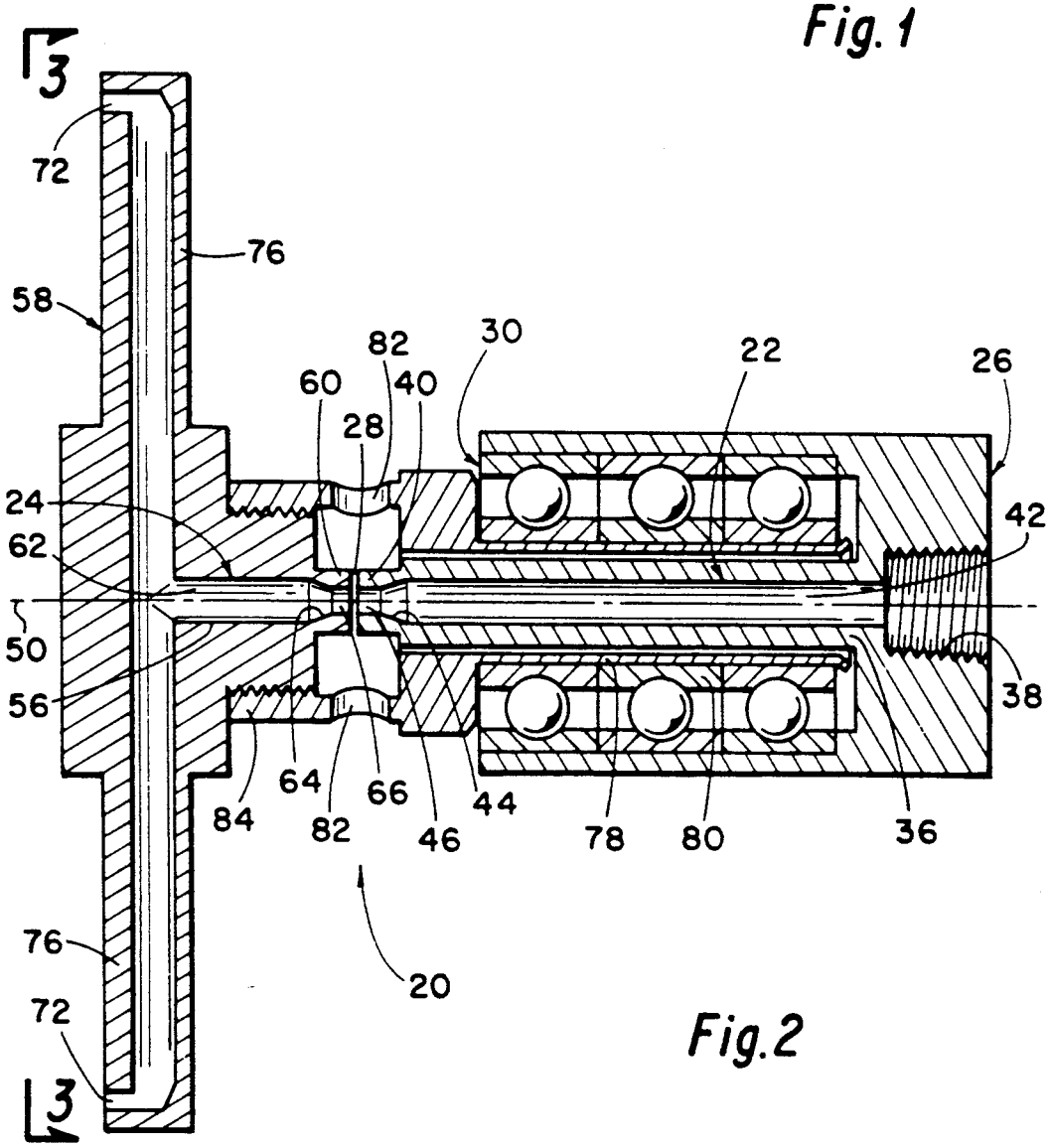
FIG. 2 is a sectional side view of an embodiment of a swivel of the present invention.
Figure 3:
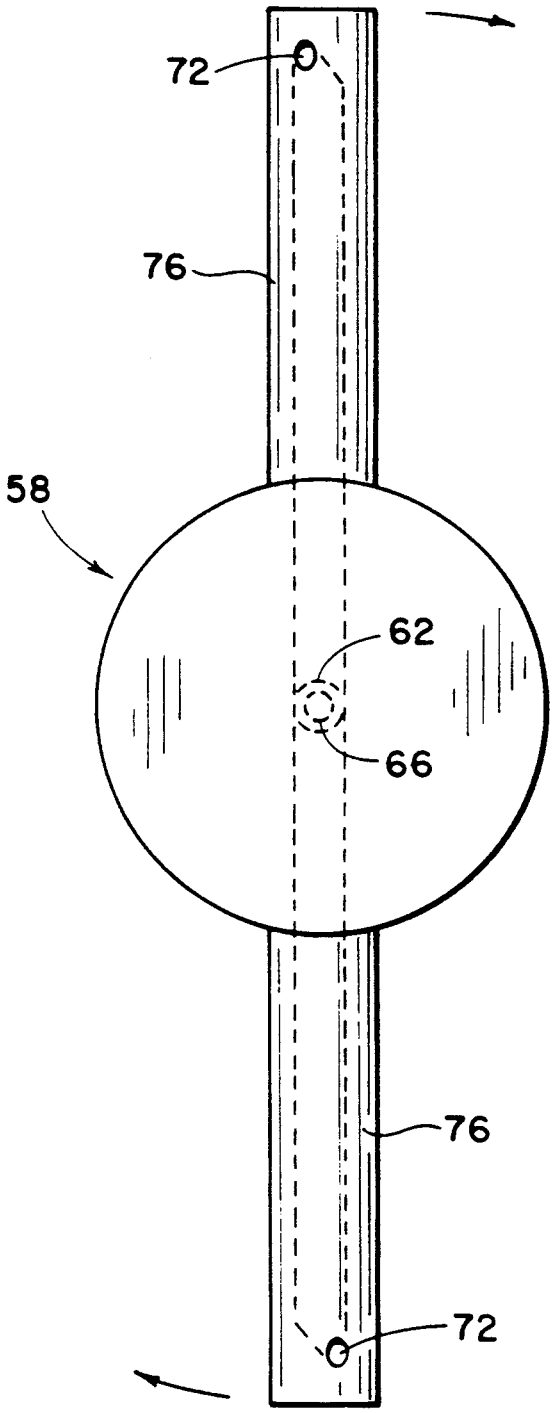
FIG. 3 is a view along line 3—3 of FIG. 2.

FIGS. 1–3 present embodiments of the apparatus and method of the fluid-conducting swivel, generally designated 20, of the present invention. Although a preferred embodiment of the swivel 20, described herein to facilitate an enabling understanding of the invention, is a high pressure surface cleaning device, as is used with pressure washing equipment for cleaning surfaces such as concrete and asphalt parking areas, sidewalks, driveways, swimming pool decks, garage floors, restaurant floors, and traffic areas; it is intended to be understood that the invention may be adapted to many applications, including snowmaking equipment, humidifying equipment for food storage and nursery hothouses, fire sprinkler heads for enclosed rooms, fire fighting diffusion nozzles for close flame suppression, showerhead spinners, fruit orchard fogging equipment, insect spray fogging equipment, private automobile and home cleaning nozzles, pollution-reducing oil and gas aerating combustion nozzles, pollution-reducing refinery flare fuel mixing and aeration nozzles, pollution-reducing incineration liquid or gas mixing nozzles, municipal sewage aeration nozzles which speed up the oxidation process, and as a fluid-conducting coupling for fluid-driven rotating equipment. It is also contemplated that the swivel of the present invention may be used as a low-friction, high-efficiency jet engine thrust-coupling which provides direct propulsion through the rotors on helicopters and eliminates the need for a rotor drive section and its mechanical losses; as a low-friction, high-efficiency thrust-coupling for the operation of turbo-prop engines which allows the jet exhaust to pass directly through the inside of each propeller blade and discharges the exhaust at right angles to the blade rotation; and as a coupling device for a high RPM turbine drive attached to an external stoichiometric, high-efficiency, pressurized combustion system capable of generating pollution-free electrical and mechanical power for municipal use and private transportation use.

Referring to the example of FIG. 1, the fluid-conducting swivel 20 may be generally described as including an upstream conduit 22, a downstream conduit 24, and support means 26 (FIG. 2) for allowing rotation of one of the upstream and downstream conduit 22, 24 and for maintaining a space or gap 28 between the upstream and downstream conduits 22, 24. The support means 26 may be designed to allow rotation of both the upstream and downstream conduits 22, 24, as would be known to one skilled in the art in view of the disclosure contained herein. The support means 26 may also be used to hold the upstream and downstream conduits 22, 24 in proper alignment, as is discussed below. The preferred support means 26 includes a bearing assembly 30 (FIG. 3) which may be connected to allow rotation of one or both of the upstream and downstream conduits 22, 24.

Referring to the example of FIG. 1, the upstream conduit 22 has a first end 36 connectable to a fluid source 38 (FIG. 2), a second end 40, and a fluid passageway 42 extending through the first and second ends 36, 40. The upstream conduit 22 also includes an acceleration nozzle 44 disposed in the fluid passageway 42 for accelerating the velocity of fluid flow through the fluid passageway 42 and an upstream throat 46 which extends between the acceleration nozzle 44 and the second end 40 of the upstream conduit 22 for maintaining the accelerated velocity of the fluid flow from the acceleration nozzle 44.

The acceleration nozzle 44 reduces the size of the fluid passageway 42 and thereby provides a means for accelerating the velocity of the fluid flow to such a velocity that the fluid exerts substantially no pressure on the walls 48 of the upstream throat 46. The acceleration nozzle 44 may also be described as providing a means for reducing the size of the fluid passageway 42 and thereby accelerating the velocity of the fluid flow to such a velocity that the fluid creates a substantially self-contained fluid jet which exerts little or no radially outward pressure and has little dissociation, particularly at points on the fluid jet in close proximity to its discharge from the second end 40 of the upstream conduit 22, as does a nozzle on a garden hose or high pressure air hose.

The upstream throat 46 has a substantially constant cross-sectional area (in radial cross-section with respect to the axis 50) in order to maintain the accelerated velocity of the fluid flow and to maintain a self-contained fluid jet created by the acceleration nozzle 44. Preferably, the acceleration nozzle 44 is frusto-conically shaped (in axial cross-section), converges in the direction of fluid flow, and the converging walls 44 form an angle of 60° or less with the axis 50 of the fluid passageway 42 and upstream throat 46. The preferred upstream throat 46 maintains the reduced size of the fluid passageway 42 created by the acceleration nozzle 44 and extends the reduced size to the upstream conduit second end 40.

The downstream conduit 24 has a first end 56 connectable to a fluid user 58 (FIGS. 2 and 3), a second end 60, and a fluid passageway 62 extending through the first and second ends 56, 60. The downstream conduit 24 also includes a deceleration nozzle 64 disposed in the fluid passageway 62 for decelerating the velocity of the fluid flow through the fluid passageway 62 and a downstream throat 66 which extends between the deceleration nozzle 64 and the second end 60 of the downstream conduit 24. The downstream throat 66 provides a means for receiving the accelerated fluid from the upstream throat 46 and for substantially preventing expansion of the accelerated fluid, thereby substantially preventing fluid leakage and pressure loss between the upstream and downstream conduits 22, 24. The downstream throat 66 receives the substantially self-contained fluid jet from the upstream throat 46 before the discharged fluid jet has time to expand or dissociate and is sized (in radial cross-section) to prevent expansion of the stream inside the throat 66.

The preferred downstream throat 66 has substantially the same radially cross-sectional area and shape (with respect to the axis 50 of the downstream throat) as the upstream throat 46 in order to substantially prevent dissociation and expansion of the fluid between the upstream and downstream throats 46, 66. If the downstream throat is substantially larger than the upstream throat, the fluid received by the downstream throat 66 will expand and ingest or inspire air or other fluid through the gap 28 which will cause an undesirable irrecoverable pressure loss between the upstream and downstream conduits 22, 24. By being designed and sized to have substantially the same radially cross-sectional area and shape as the upstream throat 46 and to have a substantially constant radially cross-sectional area along its axis 50, the downstream throat 66 also maintains the fluid flow at a substantially constant velocity between the upstream throat 46 and the deceleration nozzle 64.

The downstream throat 66 receives the accelerated fluid from the upstream throat 46 and creates a fluid seal between the second end 60 of the downstream conduit 24 and the deceleration nozzle 64 which substantially prevents expansion of the accelerated fluid upstream of the deceleration nozzle 64. In other words, by having substantially the same cross-sectional shape and area as the upstream throat, the downstream throat 66 receives the fluid discharged from the upstream throat 46 and the fluid contacts the walls 68 of the downstream throat 66 which creates a fluid seal which prevents the ingestion or inspiration of air or other fluid through the gap 28 into the downstream throat 66 and thereby prevents an undesirable, irrecoverable loss of fluid pressure between the upstream and downstream conduits 22, 24. The fluid passageway 62 and fluid user 58 should be sized to allow fluid flow through the swivel 20 without sufficient restriction to cause back pressure in the downstream throat 66 and space or gap 28.

The deceleration nozzle 64 provides a means for enlarging the size of the fluid passageway 62 and thereby decelerates the velocity of the fluid flow through the passageway 62. The preferred deceleration nozzle 64 is frusto-conically shaped (in axial cross-section), diverges in the direction of flow, and has walls 64 which form an angle of 60° or less with the flow axis 50 of the downstream throat 66. Preferably, the acceleration and deceleration nozzles 44, 64 are substantially identical and equidistantly spaced from the second ends 40, 60 of the upstream and downstream conduits 22, 24. More preferably, the nozzles 44, 64; upstream and downstream conduits 22, 24; and upstream and downstream throats 46, 66 are substantially symmetrical in axial cross-section, as exemplified in FIGS. 1 and 2.

In a preferred embodiment, referring to the example of FIGS. 2 and 3, the fluid user 58 includes at least one discharge nozzle 72 in fluid communication with the first end 56 of the downstream conduit 24. The discharge nozzle 72 is displaced radially with respect to the axis 50 of the downstream throat 66 and is directed downstream along an axis that is skewed with respect to the axis 50 and lies in a plane parallel to the axis 50 in order to cause rotation of the downstream conduit 24 about the axis 50.

FIGS. 2 and 3 exemplify a prototype of the inventive swivel 20 which is adapted for use as a high-pressure rotating cleaning device such as may be used in cleaning concrete surfaces, cleaning rusted surfaces, cleaning painted surfaces, in rotating car wash nozzles, etc. Since the prototype swivel 20 does not have friction-generating, surface-contacting seals but instead uses the accelerated velocity of the fluid stream to effectively seal the gap 28 between the upstream and downstream conduits 22, 24 and recovers on the order of 97% of the pressure drop used to accelerate the fluid, the fluid pressure may be efficiently used to both rotate the discharge nozzles 72 and clean the desired surface.

Referring to the example of FIGS. 2 and 3, in the prototype swivel 20, the fluid user 58 includes two diametrically opposed discharge nozzles 72. Each nozzle 72 is displaced radially with respect to the axis 50. The nozzles 72 are directed so that they discharge downstream (in the same general direction as the flow through the swivel 20 and downstream conduit 24) along an axis that is skewed or at an angle with respect to the axis 50 and which lies in a plane parallel to the axis 50 in order to cause rotation of the discharge nozzle 72 and downstream conduit 24 about the axis 50. In the prototype swivel 20, the discharge nozzles 72 are equidistantly spaced from the axis 50. The distance between the axis 50 and the discharge axis of the discharge nozzle 72 may be selected to control the speed of rotation of the discharge nozzle 72. Also, the angle at which the discharge nozzles 72 discharge may be selected to control the speed of rotation of the discharge nozzles for a given fluid and discharge pressure, as would be known to one skilled in the art in view of the disclosure contained herein. The speed of rotation will be proportional to the thrust generated at the discharge nozzles and the skew or angle of the discharge nozzles, i.e., since the swivel 20 has no friction creating sealing surfaces to retard the speed of rotation, the swivel's ability to operate within a broad range of rotational speeds is dependent only on the selection of the bearing assembly 30, the distance the discharge nozzles 72 are displaced from the flow axis 50, and the skew or angle at which the discharge nozzles 72 discharge with respect to the axis 50. In the prototype swivel 20 and fluid user 58, the discharge nozzles 72 are located at the end of conduital arms 76 which transmit the fluid to the nozzles 72 along a flow path about perpendicular to the axis 50 of the downstream conduit 24. In the prototype swivel, as viewed in FIG. 3, the nozzles 72 are skewed an angle of about twenty degrees (20°) counterclockwise with respect to the longitudinal axis of arms 76) so that the thrust generated at the nozzles rotates the arms 76 in a clockwise direction (as viewed in FIG. 3).

In the prototype swivel 20, the fluid user 58 is connected to the downstream conduit 24. The downstream conduit 24 and deceleration nozzle 64 may be integrally formed with the fluid user 58 or may be separate components, depending upon the materials of construction. The fluid user 58 is also connected to the bearing retainer 78 so that the fluid user 58 and downstream conduit 24 rotate with the inner bearing race 80. Orifices 82 are provided in bearing retainer housing 84 to allow for discharge of any leakage or fluid accumulation (such as will occur if the gap 28 is adjusted so that there is a positive pressure outside the conduits 22, 24 at the gap 28). In the prototype swivel 20, three evenly spaced orifices 82 are provided. In the prototype swivel 20, the bearing retainer housing 84 is a component of the support means 26 and as such is used to align and position the upstream and downstream conduits 22, 24. The prototype upstream and downstream conduits are positioned so that the upstream and downstream throats 46, 66 are axially and concentrically aligned along axis 50. The fluid user 58 is threadably engaged with the bearing retainer housing 84 to allow adjustment of the size of the space or gap 28, i.e., to adjust the distance between the second ends 40, 60 of the upstream and downstream conduits 22, 24, as will be further discussed below.

The upstream conduit 22 extends inside the bearing retainer 78 so that the second ends 40, 60 of the upstream and downstream conduits 22, 24 are adjacent. The upstream conduit 22 does not contact the bearing retainer housing 84. The first end 36 of the upstream conduit is connected to a fluid source 38, which is illustrated as a high pressure fluid connection or fitting which can be connected to a pump, compressor, or other fluid supply. The maximum pressure rating of the swivel 20 is limited only by the strength of the materials of which the swivel 20 and fluid user 58 are manufactured. The first end 36 of the upstream conduit 22 is also connected to the support means 26 which forms the bearing housing. This bearing housing and upstream conduit 22 are fixed so that the downstream conduit 24 and fluid user 58 rotate with respect to the bearing housing 26.

In the prototype swivel 20, the fluid user 58 and downstream conduit 24 are screwed into the bearing retainer housing 84 until contact is made between the second ends 40, 60 of the upstream and downstream conduits 22, 24. The fluid user 58 is then unscrewed just enough to allow rotation of the fluid user 58 and downstream conduit 24 without contact between the second ends 40, 60. This creates a space or gap 28 between the second ends 40, 60 on the order of one or two thousandths of an inch. The space or gap 28 should be adjusted so that there is zero or slightly positive pressure on the outside of the conduits 22, 24 adjacent the gap 28 during operation of the swivel 20, in order to prevent inspiration of air or fluid through the gap and undesirable irrecoverable pressure loss in the fluid flowing through the swivel 20. Normally, the gap 28 will be as small as mechanically possible without the second ends 40, 60 of the conduits 22, 24 making contact. The gap 28 should be sufficiently spaced to accommodate expansion characteristics of the materials of which the swivel 20 is constructed and to allow for thermal expansion of the materials at the operating temperatures of the swivel 20.

As previously mentioned, the fluid user 58 and fluid passageways downstream of the deceleration nozzle 64 should be sized, in view of the anticipated fluid properties and operating pressures within the swivel, to pass the fluid without creating undesirable back pressure in the downstream throat 66 and gap 28. In the prototype swivel 20, the upstream conduit 22 has an internal diameter of 0.272 inches, the upstream throat 46 has an internal diameter of 0.073 inches, and the acceleration nozzle 44 converges at an angle of about 60°. The downstream conduit 24 has an internal diameter of 0.272 inches, the downstream throat 66 has an internal diameter of 0.076 inches, and the deceleration cone diverges at an angle of approximately 60°. The internal diameter of each of the upstream and downstream throats 46, 66 is constant along the length or flow axis of the throat in order to stabilize the rate of change of the fluid velocity at the gap 28 and minimize the possibility of fluid expansion and fluid inspiration at the gap 28.

In an operational test of the prototype swivel 20, the fluid source 38 was connected to a pump having a discharge pressure of 1000 psig at 3 gallons per minute. In the test, the pressure in the upstream conduit 22 was measured at 1000 psig and the recovered pressure in the downstream conduit 24 downstream of the deceleration nozzle 64 was measured at 975 psig. Subsequent tests with pumps having capacities of 4 gallons per minute and 4.5 gallons per minute and discharge pressures of up to 3000 psi have also resulted in pressure recoveries downstream of the deceleration nozzle 64 on the order of about 97% of the pressure upstream of the acceleration nozzle 44.

Although the swivel will work with liquid or gas, gas will require a higher velocity to prevent dissociation at the gap 28. In the operational test, water was used as the test fluid. It was observed that the prototype swivel worked best at fluid velocities in the upstream and downstream throats 46, 66 of between 200 and 320 feet per second. It is intended to be understood that subsequent swivel designs using this invention may, because of different cross-sectional areas and shapes or many other factors, operate best at substantially higher or lower velocity rates. In any given application, good design criteria dictate that the conduits 22, 24, throats 46, 66, and nozzles 44, 64 should be sized, taking into account the fluid properties and operating pressures, as well as other relevant factors, so that the fluid velocities in the throats 46, 66 are high enough to prevent dissociation of the fluid stream at the gap 28 and are low enough to prevent developing a vacuum at the gap 28.

In the prototype swivel 20, the internal diameter of the downstream throat 66 was three thousandths of an inch larger than the upstream throat 46 to allow for a slight misalignment between the upstream and downstream conduits 22, 24 and greater than 97% pressure recovery was obtained, as previously discussed. In the prototype swivel, only a small, insignificant loss of fluid occurred at the gap 28 and it is contemplated that this was due to the concentricity mismatch of the upstream and downstream throats 46, 66. Ideally, the upstream and downstream throats 46, 66 would be identically the same shape (normally circular or cylindrical) and internal diameter and the reason they are not in the prototype swivel 20 is to compensate for alignment variations. The internal diameter of the downstream throat 66 is sufficiently matched to that of the upstream throat 46 that it is possible to create a slightly positive pressure outside the conduits 22, 24 at the gap 28 while maintaining a large enough gap to prevent contact between the first and second conduits 22, 24 during rotation. It is contemplated that pressure recoveries downstream of the deceleration nozzle 64 much closer to 100% of the applied pressure upstream of the acceleration nozzle 44 may be obtained as the dimensions and shapes of the fluid passageways 42, 62, nozzles 44, 64, and throats 46, 66 are optimized.

Another discovery made during testing was that when the static recovered pressure downstream of the deceleration nozzle 64 is added to the calculated pressure increase due to the centrifugal pump effect of the discharge nozzles 72 rotating at high speeds, the effective discharge pressure downstream of the discharge nozzles 72 may be higher than the pump discharge pressure at the fluid source 38. At the present time, the inventors have not actually measured this pressure, although it is contemplated that it may be calculated from the length of the conduit arm 76 and the rotational velocity of the nozzles 72.

Two or more of the swivels 20 may be serially connected or staged to achieve higher rotational speeds without multiplying any form of sealing friction, as would occur if conventionally sealed swivels were mounted serially. For example, the conduit arms 76 and discharge nozzles 72 of FIG. 2 may be replaced with a second bearing housing 26 having a second bearing assembly 30, second upstream conduit 22, and second acceleration nozzle 44 with the fluid user 58 connected to a second bearing retainer housing for the second bearing assembly 30. This sequential staging of two swivels would allow the discharge nozzles to rotate at twice the maximum speed of the individual bearing assemblies, e.g., if the bearing assemblies were individually rotated for 5,000 RPM, the discharge nozzles would rotate at a maximum speed of approximately 10,000 RPM with each individual bearing assembly rotating at its maximum of 5,000 RPM.

Referring to the examples of FIGS. 1 and 2, the method of making a fluid-conducting swivel 20 includes accelerating the velocity of a fluid flowing in a fluid passageway 42 from a first end 36 through a second end 40 of an upstream conduit 22; receiving the fluid discharge from the second end 40 of the upstream conduit 22 in a fluid passageway 62 in the second end 60 of a downstream conduit 24 and substantially preventing expansion of the fluid discharge from the upstream conduit 22; substantially preventing expansion of the fluid in a downstream throat 66 of the fluid passageway 62 of the downstream conduit 24, the downstream throat 66 extending from the second end 60 of the downstream conduit 24 to a deceleration nozzle 64 in the fluid passageway 62 of the downstream conduit 24; rotatably mounting one of the upstream and downstream conduits 22, 24 for rotation about an axis 50 extending through the adjacent second ends 40, 60 of the upstream and downstream conduits 22, 24; and maintaining a space 28 between the adjacent second ends 40, 60 of the upstream and downstream conduits 22, 24. The method provides for reducing the size of the fluid passageway 42 with an acceleration nozzle 44 disposed in the upstream conduit 22 and thereby accelerating the fluid velocity to such a velocity that the fluid exerts substantially no pressure on the walls 48 of the fluid passageway. The method also provides for reducing the size of the fluid passageway 42 with the acceleration nozzle 44 and accelerating the velocity of the fluid flow to such a velocity that the fluid creates a substantially self-contained fluid jet. The upstream conduit 22 includes an upstream throat 46 having a substantially constant cross-sectional area in order to maintain the velocity of the self-contained fluid jet from the acceleration nozzle 44 to the upstream conduit second end 40.

The method provides the downstream throat 66 having substantially the same cross-sectional area and shape as the upstream throat 46 in order to substantially prevent dissociation and expansion of the fluid in the gap 28 between the upstream and downstream throats 44, 66. The downstream throat 66 maintains the fluid flow at a substantially constant velocity between the upstream throat 46 and the deceleration nozzle 64. The downstream throat 66 provides for receiving the accelerated fluid and creating a fluid seal between the second end 60 of the downstream conduit 24 and the deceleration nozzle 64 in order to substantially prevent expansion of the accelerated fluid upstream of the deceleration nozzle 64.

While presently preferred embodiments of the invention have been described herein for the purpose of disclosure, numerous changes in the construction and arrangement of parts and the performance of steps will suggest themselves to those skilled in the art in view of the disclosure contained herein, which changes are encompassed within the spirit of this invention, as defined by the following claims.

What is claimed is:

1. A fluid-conducting swivel, comprising:

(a) an upstream conduit having a first end connectable to a fluid source, a second end, and a fluid passageway extending through the first and second ends, the upstream conduit comprising:

an acceleration nozzle disposed in the fluid passageway for accelerating the velocity of the fluid flow; and an upstream throat, extending between the acceleration nozzle and the second end of the upstream conduit, for maintaining the accelerated velocity of the fluid flow from the acceleration nozzle;

(b) a downstream conduit having a first end connectable to a fluid user, a second end, and a fluid passageway extending through the first and second ends, the downstream conduit comprising:

a deceleration nozzle disposed in the fluid passageway for decelerating the velocity of the fluid flow; and a downstream throat, extending between the deceleration nozzle and the second end of the downstream conduit, for receiving the accelerated fluid from the upstream throat and substantially preventing expansion of the accelerated fluid, thereby substantially preventing fluid leakage and pressure loss between the upstream and downstream conduits; and (c) support means for holding the upstream and downstream conduits with the upstream and downstream throats aligned, for allowing rotation of one of the upstream and downstream conduits and for maintaining a space between the upstream and downstream conduits and between the upstream and downstream throats.

2. Swivel of claim 1:

wherein the support means allows rotation of both the upstream and downstream conduits.

3. Swivel of claim 1:

wherein the acceleration nozzle is defined as reducing the size of the fluid passageway and thereby accelerating the velocity of the fluid flow to such a velocity that the fluid exerts substantially no pressure on the walls of the upstream throat.

4. Swivel of claim 1:

wherein the acceleration nozzle is defined as reducing the size of the fluid passageway and thereby accelerating the velocity of the fluid flow to such a velocity that the fluid creates a substantially self-contained fluid jet.

5. Swivel of claim 4:

wherein the upstream throat is defined as extending the reduced size of the fluid passageway and having a substantially constant cross-sectional area in order to maintain the self-contained fluid jet.

6. Swivel of claim 1:

wherein the downstream throat is defined as having substantially the same cross-sectional area and shape as the upstream throat in order to substantially prevent dissociation and expansion of the fluid between the upstream and downstream throats.

7. Swivel of claim 6:

wherein the downstream throat is defined as maintaining the fluid flow at a substantially constant velocity between the upstream throat and the deceleration nozzle.

8. Swivel of claim 1:

wherein the downstream throat is defined as receiving the accelerated fluid and creating a fluid seal between the second end of the downstream conduit and the deceleration nozzle in order to substantially prevent expansion of the accelerated fluid upstream of the deceleration nozzle.

9. Swivel of claim 1 in which the fluid user comprises:

at least one discharge nozzle in fluid communication with the first end of the downstream conduit and displaced radially with respect to the flow axis of the downstream throat and directed downstream along an axis that is skewed with respect to the flow axis and lies in a plane parallel to the flow axis in order to cause rotation of the downstream conduit about the flow axis.

10. A friction-generating-seal-free fluid-conducting swivel, comprising:

(a) an upstream conduit having a first end connectable to a fluid source, a second end, and a fluid passageway extending through the first and second ends, the upstream conduit comprising:

an acceleration nozzle disposed in the fluid passageway for accelerating the velocity of the fluid flow to such a velocity that the fluid creates a substantially self-contained fluid jet; and an upstream throat, extending between the acceleration nozzle and the second end of the upstream conduit, for maintaining the accelerated velocity of the fluid flow from the acceleration nozzle;

(b) a downstream conduit having a first end connectable to a fluid user, a second end, and a fluid passageway extending through the first and second ends, the downstream conduit comprising:

a deceleration nozzle disposed in the fluid passageway for decelerating the velocity of the fluid flow; and a downstream throat, extending between the deceleration nozzle and the second end of the downstream conduit and having substantially the same cross-sectional area and shape as the upstream throat in order to receive the accelerated fluid from the upstream throat and substantially prevent dissociation and expansion of the accelerated fluid between the upstream and downstream throats; and (c) support means for holding the upstream and downstream conduits with the upstream and downstream throats aligned, for allowing rotation of one of the upstream and downstream conduits, and for maintaining a space between the upstream and downstream conduits and between the upstream and downstream throats.

11. Swivel of claim 10:

wherein the downstream throat is defined as receiving the accelerated fluid and creating a fluid seal between the second end of the downstream conduit and the deceleration nozzle in order to substantially prevent expansion of the accelerated fluid upstream of the deceleration nozzle.

12. Swivel of claim 10 in which the fluid user comprises:

at least one discharge nozzle in fluid communication with the first end of the downstream conduit and displaced radially with respect to the flow axis of the downstream throat and directed downstream along an axis that is skewed with respect to the flow axis and lies in a plane parallel to the flow axis in order to cause rotation of the downstream conduit about the flow axis.

13. A method of operating a fluid-conducting swivel, comprising:

(a) accelerating the velocity of a fluid flowing in a fluid passageway from a first end through a second end of an upstream conduit of said swivel;

(b) receiving the fluid discharged from the second end of the upstream conduit in a fluid passageway in the second end of a downstream conduit of said swivel and substantially preventing expansion of the fluid discharged from the upstream conduit;

(c) substantially preventing expansion of the fluid in a downstream throat of the fluid passageway of the downstream conduit, the downstream throat extending from the second end of the downstream conduit to a deceleration nozzle in the fluid passageway of the downstream conduit;

(d) rotatably mounting at least one of the upstream and downstream conduits for rotation about an axis extending through the adjacent second ends of the upstream and downstream conduits; and (e) maintaining a space between the adjacent second ends of the upstream and downstream conduits.

14. Method of claim 13 in which step (d) comprises:

rotatably mounting both the upstream and the downstream conduit.

15. Method of claim 13 in which step (a) comprises:

reducing the size of the fluid passageway with an acceleration nozzle disposed in the upstream conduit and thereby accelerating the fluid velocity to such a velocity that the fluid exerts substantially no pressure on the walls of the fluid passageway.

16. Method of claim 13 in which step (a) comprises:

reducing the size of the fluid passageway with an acceleration nozzle disposed in the upstream conduit and thereby accelerating the velocity of the fluid flow to such a velocity that the fluid creates a substantially self-contained fluid jet.

17. Method of claim 16 in which the upstream conduit comprises:

an upstream throat having a substantially constant cross-sectional area in order to maintain the velocity of the self-contained fluid jet.

18. Method of claim 17:

wherein the downstream throat is defined as having substantially the same cross-sectional area and shape as the upstream throat in order to substantially prevent dissociation and expansion of the fluid between the upstream and downstream throats.

19. Method of claim 18:

wherein the downstream throat is defined as maintaining the fluid flow at a substantially constant velocity between the upstream throat and the deceleration nozzle.

20. Method of claim 13:

wherein the downstream throat is defined as receiving the accelerated fluid and creating a fluid seal between the second end of the downstream conduit and the deceleration nozzle in order to substantially prevent expansion of the accelerated fluid upstream of the deceleration nozzle.

* * * * *